US010550621B2

(12) United States Patent
Cavarec et al.

(10) Patent No.: US 10,550,621 B2
(45) Date of Patent: Feb. 4, 2020

(54) SLIDING WINDOW FOR A BUILDING AND HOME-AUTOMATION SYSTEM COMPRISING SUCH A SLIDING WINDOW

(71) Applicant: SOMFY ACTIVITES SA, Cluses (FR)

(72) Inventors: Pierre-Emmanuel Cavarec, Mont Saxonnex (FR); Marc Brechemier, Canet en Roussillon (FR); Sébastien Anthoine, Sallanches (FR); Thierry Garby, Chatillon sur Cluses (FR); Christophe Jacquin, Samoens (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 16/332,286

(22) PCT Filed: Sep. 11, 2017

(86) PCT No.: PCT/EP2017/072764
§ 371 (c)(1),
(2) Date: Mar. 11, 2019

(87) PCT Pub. No.: WO2018/046731
PCT Pub. Date: Mar. 15, 2018

(65) Prior Publication Data

US 2019/0345752 A1 Nov. 14, 2019

(30) Foreign Application Priority Data

Sep. 12, 2016 (FR) ..... 16 58472

(51) Int. Cl.
*E05F 15/643* (2015.01)

(52) U.S. Cl.
CPC ..... *E05F 15/643* (2015.01); *E05Y 2201/66* (2013.01); *E05Y 2201/664* (2013.01); *E05Y 2900/148* (2013.01)

(58) Field of Classification Search
CPC ..... E05F 15/643; E05F 11/48
See application file for complete search history.

(56) References Cited

U.S. PATENT DOCUMENTS 164,038 A * 6/1875 Robertson ..... E05F 15/643 49/102
3,890,744 A * 6/1975 Galis ..... E05F 15/643 49/360

(Continued)

FOREIGN PATENT DOCUMENTS

CN 101532365 9/2009
CN 201679398 12/2010

(Continued)

OTHER PUBLICATIONS

International Search Report, dated Nov. 20, 2017, from corresponding PCT/EP2017/072764 application.

(Continued)

*Primary Examiner* — Catherine A Kelly
(74) *Attorney, Agent, or Firm* — Young & Thompson

(57) ABSTRACT

Disclosed is a sliding window for a building, including a frame, an opening member and a motorized drive device. The device includes an electromechanical actuator, a flexible element and a pulley for winding the flexible element. The pulley is rotated by an output shaft of the actuator. One end of a first strand of the flexible element connects to a first portion of the pulley. One end of a second strand of the flexible element connects to a second portion of the pulley. The pulley and the output shaft have the same axis of rotation. The device also includes a first angle transmission mechanism engaging the first strand, so as to guide the first strand relative to the first portion of the pulley, and a second angle transmission mechanism engaging with the second strand, so as to guide the second strand relative to the second portion of the pulley.

15 Claims, 9 Drawing Sheets

(56) References Cited

U.S. PATENT DOCUMENTS

| | | | | |
|---|---|---|---|---|
| 4,893,435 | A * | 1/1990 | Shalit | E05F 15/643 49/139 |
| 5,377,448 | A * | 1/1995 | Boyd | E05F 1/025 49/360 |
| 6,108,977 | A * | 8/2000 | Payne | E05F 15/603 49/360 |
| 6,918,210 | B1 * | 7/2005 | Smiley | E05F 15/643 49/347 |
| 7,325,361 | B2 * | 2/2008 | Rogers, Jr. | E05F 15/643 296/155 |
| 8,161,683 | B2 | 4/2012 | Van Parys | |
| 8,324,842 | B2 * | 12/2012 | Gasser | A47B 88/457 318/14 |
| 8,407,941 | B2 * | 4/2013 | Chang | E05D 15/063 49/116 |
| 1,795,452 | A1 | 8/2013 | Smelser | |
| 9,452,761 | B2 * | 9/2016 | Romero | B61B 1/02 |
| 10,015,843 | B2 * | 7/2018 | Ackerman | B60J 1/1853 |
| 10,392,854 | B2 * | 8/2019 | Ottmann | E05F 15/643 |
| 2001/0033142 | A1 * | 10/2001 | Wan-Sheng | E05F 15/56 318/445 |
| 2010/0095596 | A1 * | 4/2010 | Luca | A47K 3/34 49/360 |
| 2011/0107671 | A1 * | 5/2011 | Lloyd | E05F 11/54 49/32 |
| 2017/0009507 | A1 | 1/2017 | Newman | |
| 2018/0044966 | A1 * | 2/2018 | Brand | E05F 15/643 |

FOREIGN PATENT DOCUMENTS

| | | | | |
|---|---|---|---|---|
| CN | 203 160 952 | U | 8/2013 | |
| FR | 3029958 | A1 * | 6/2016 | E05D 15/0639 |
| FR | 3043122 | A1 * | 5/2017 | E05F 15/643 |
| WO | 2017007944 | A1 | 1/2017 | |

OTHER PUBLICATIONS

FR Search Report, dated May 22, 2017, from corresponding FR 1658472 application.

* cited by examiner

SLIDING WINDOW FOR A BUILDING AND HOME-AUTOMATION SYSTEM COMPRISING SUCH A SLIDING WINDOW

The present invention relates to a sliding window for a building comprising a motorized drive device for moving a leaf relative to a frame in a sliding movement.

The present invention also relates to a home automation facility comprising such a sliding window.

In general, the present invention relates to the field of windows comprising a motorized drive device setting a leaf in motion relative to a frame in a sliding movement, between at least one first position and at least one second position.

A motorized drive device of such a window comprises an electromechanical actuator.

Already known is document CN 203 160 952 U, which describes a sliding window for a building comprising a frame, a leaf and a motorized drive device for moving the leaf by sliding relative to the frame. The motorized drive device comprises a flexible element, of the cable type, a carriage and a pulley for winding the flexible element, and an electromechanical actuator, which includes an electric motor and an output shaft. The rotation axis of the output shaft is parallel to the sliding direction of the leaf relative to the frame. The flexible element rotates around angle transmission pulleys, and its movement is driven by the electromechanical actuator. The flexible element comprises a first strand and a second strand. The carriage is, on the one hand, attached on the leaf, and, on the other hand, connected to the flexible element. The winding pulley is rotated by the output shaft of the electromechanical actuator. One end of the first strand of the flexible element is connected to a first part of the winding pulley. One end of the second strand of the flexible element is connected to a second part of the pulley.

The motorized drive device also comprises a conical gear reduction mechanism connected, on the one hand, to the output shaft of the electromechanical actuator, and, on the other hand, to the winding pulley.

However, such an arrangement of the motorized drive device of the sliding window has the drawback of offsetting the winding pulley on one side of the electromechanical actuator, relative to a longitudinal axis of the electromechanical actuator.

As a result, this motorized drive device has a substantial bulk, in particular along the thickness of the frame, and is complex to manufacture.

Furthermore, the sliding window is expensive to obtain due to the conical gear reduction mechanism belonging to the motorized drive device.

Moreover, such an arrangement of the mechanical connection between the output shaft of the electromechanical actuator and the winding pulley has the drawback of a mechanical fragility that may reduce the reliability of the motorized drive device.

The present invention aims to resolve the aforementioned drawbacks and to propose a sliding window for a building comprising a motorized drive device for moving a leaf relative to a frame in a sliding movement, as well as a home automation facility comprising such a sliding window, making it possible to minimize the bulk of the motorized drive device, simplify the industrialization and construction of the motorized drive device and improve the operating reliability of the window, while minimizing the costs of obtaining the window.

To that end, according to a first aspect, the present invention relates to a sliding window for a building comprising:

a frame, at least one leaf, a motorized drive device for moving the leaf by sliding relative to the frame, the motorized drive device comprising:

an electromechanical actuator, the electromechanical actuator comprising an electric motor and an output shaft, the rotation axis of the output shaft being parallel to the sliding direction of the leaf relative to the frame, a flexible element, the flexible element being moved by the electromechanical actuator, the flexible element comprising a first strand and a second strand, a carriage, the carriage being, on the one hand, attached on the first leaf, and, on the other hand, connected to the flexible element, a winding pulley of the flexible element, the winding pulley being rotated by the output shaft of the electromechanical actuator, one end of the first strand of the flexible element being connected to a first part of the winding pulley, one end of the second strand of the flexible element being connected to a second part of the winding pulley.

According to the invention, the winding pulley and the output shaft of the electromechanical actuator have a same rotation axis. The motorized drive device further comprises a first angle transmission mechanism cooperating with the first strand of the flexible element, so as to guide the first strand of the flexible element relative to the first part of the winding pulley, and a second angle transmission mechanism cooperating with the second strand of the flexible element, so as to guide the second strand of the flexible element relative to the second part of the winding pulley.

Thus, the winding pulley is arranged in the extension of the output shaft of the electromechanical actuator and is rotated around the same rotation axis as the output shaft of the electromechanical actuator.

Furthermore, the first and second strands of the flexible element are respectively guided using the first and second angle transmission mechanisms relative to the first and second parts of the winding pulley.

In this way, the motorized drive device is made compactly, while guaranteeing reliable operation of the window.

Furthermore, the flexible element forms a so-called open loop between the end of the first strand connected to the first part of the winding pulley and the end of the second strand connected to the second part of the winding pulley.

In this way, the first and second strands of the flexible element are connected to the winding pulley and separated at the first and second parts thereof.

According to one preferred feature of the invention, the winding, respectively unwinding, direction of the first strand of the flexible element around the first part of the winding pulley is opposite the winding, respectively unwinding, direction of the second strand of the flexible element around the second part of the winding pulley.

According to one advantageous feature of the invention, each of the first and second angle transmission mechanisms comprises an angle transmission pulley of one of the first and second strands of the flexible element.

According to another advantageous feature of the invention, each of the first and second angle transmission mechanisms also comprises a guide element of one of the first and second strands of the flexible element. Furthermore, the guide element and the angle transmission pulley of each of the first and second angle transmission mechanisms are configured to cooperate with one another, so as to guide one of the first and second strands of the flexible element.

According to another preferred feature of the invention, the frame comprises an upper crosspiece, a lower crosspiece and two lateral uprights. Furthermore, the electromechanical actuator is attached on the upper crosspiece of the frame using fasteners.

According to another advantageous feature of the invention, the flexible element of the motorized drive device extends along the upper crosspiece of the frame from the first part of the winding pulley to the second part of the winding pulley.

According to another advantageous feature of the invention, the flexible element extends, on the one hand, from one side of the upper face of the upper crosspiece, and, on the other hand, from one side of a lower face of the upper crosspiece, along at least part of the length of the upper crosspiece of the frame.

According to another advantageous feature of the invention, the upper crosspiece of the frame comprises at least one guide element of the flexible element extending along the length of the upper crosspiece.

According to another advantageous feature of the invention, the electromechanical actuator and the winding pulley are assembled on the frame using a first support and a second support. Furthermore, a mechanism, forming a slider connection along the rotation axis, is arranged between, on the one hand, one of the first and second supports, and, on the other hand, the winding pulley or one end of the electromechanical actuator.

According to another advantageous feature of the invention, the first and second strands of the flexible element are connected to a locking and unlocking mechanism of the first leaf relative to the frame.

According to another advantageous feature of the invention, the first strand of the flexible element comprises a first end connected to the first part of the winding pulley and a second end connected to the locking and unlocking mechanism. Furthermore, the second strand of the flexible element comprises a first end connected to the second part of the winding pulley and a second end connected to the locking and unlocking mechanism.

According to a first embodiment of the invention, the first and second strands of the flexible element extend in opposite directions, from first and second angle transmission mechanisms.

According to a second embodiment of the invention, the first and second strands of the flexible element extend in a same direction, from first and second angle transmission mechanisms.

According to another advantageous feature of the invention, a length, measured parallel to a movement direction of the leaf, of an assembly, formed at least by the electromechanical actuator and the winding pulley, is smaller than the width of the leaf, measured parallel to the same direction.

According to a second aspect, the present invention relates to a home automation facility comprising a sliding window according to the invention.

This home automation facility has features and advantages similar to those previously described, relative to the sliding window according to the invention.

Other particularities and advantages of the invention will also appear in the description below.

In the appended drawings, provided as non-limiting examples:

First described, in reference to FIGS. 1 to 4, is a home automation facility according to the invention and installed in a building including an opening 1, in which a sliding window 2, according to a first embodiment of the invention, is arranged.

The sliding window 2 can also be called sliding pocket.

The present invention applies to sliding windows and sliding patio doors, which may or may not be equipped with transparent glazing.

The window 2 comprises at least one leaf 3*a*, 3*b* and a frame 4.

Figure 1:
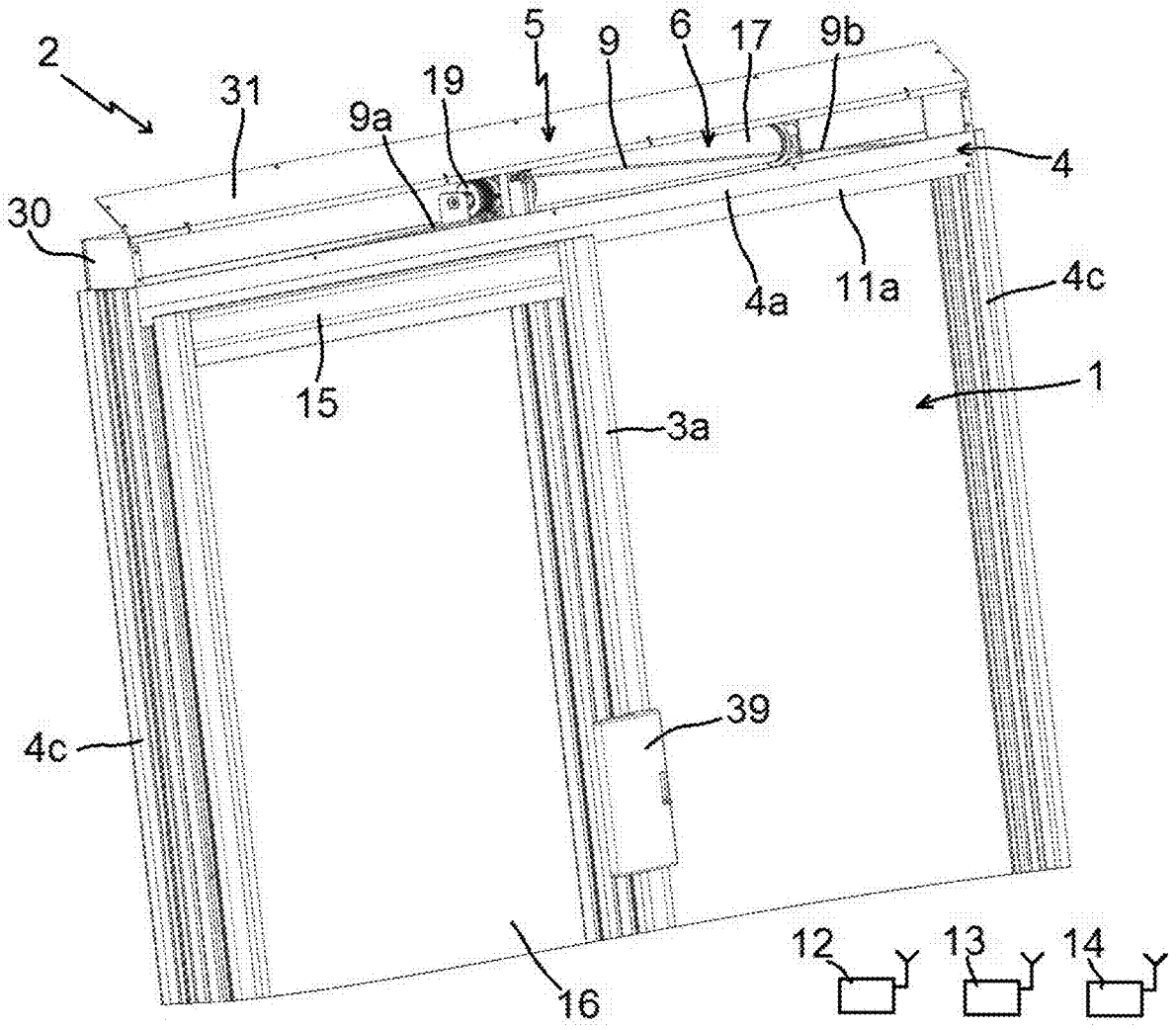
FIG. 1 is a partial schematic perspective view of the sliding window according to a first embodiment of the invention, where a first leaf is in an open position relative to a frame and where an access hatch for a box housing a motorized drive device is in the open position.
Figure 2:
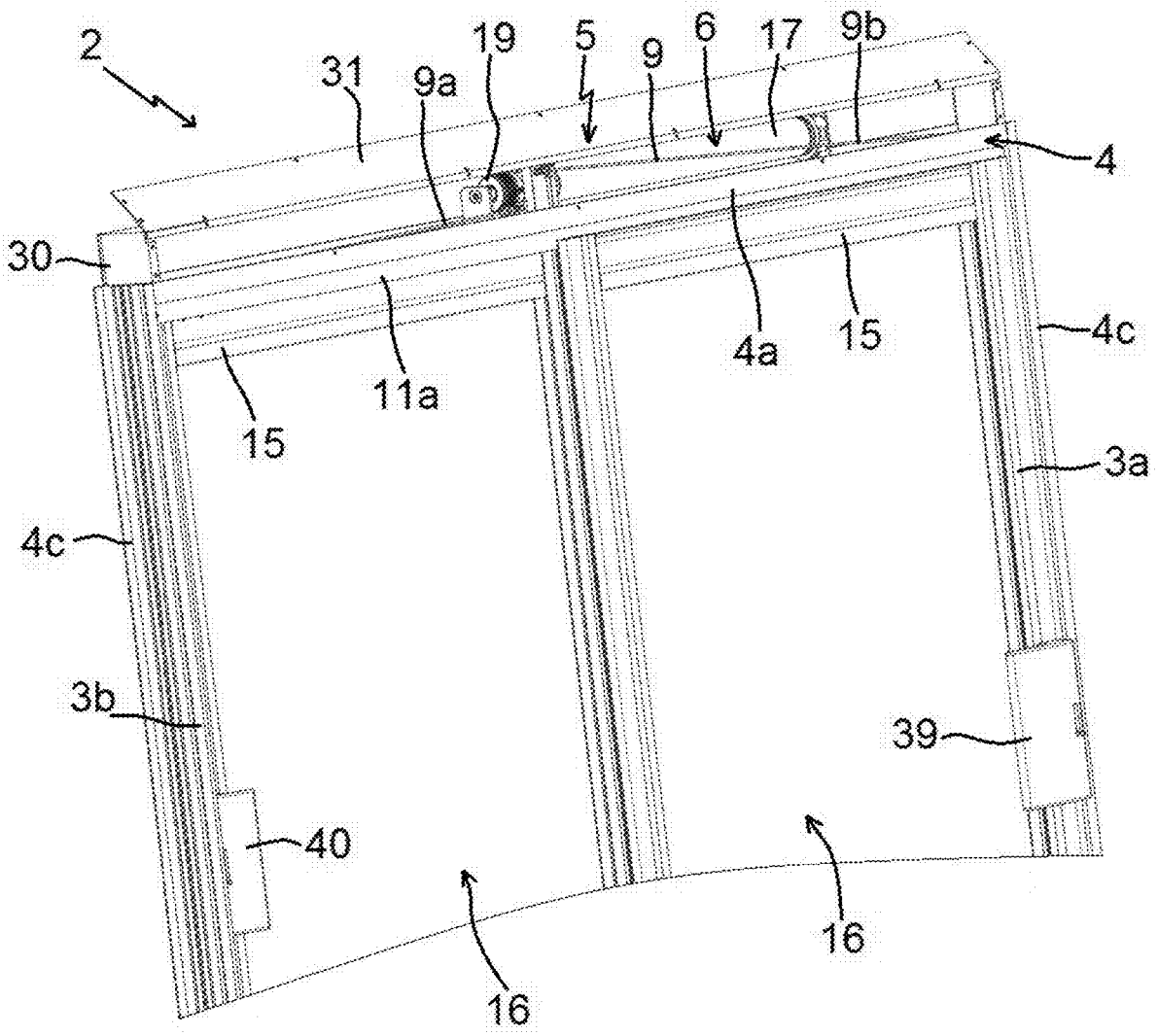
FIG. 2 is a view similar to FIG. 1, where the leaf is in a closed position relative to the frame.

Here, and as illustrated in FIGS. 1 and 2, the window 2 comprises a first leaf 3*a* and a second leaf 3*b*.

The window 2 also comprises a motorized drive device 5 for moving a leaf 3*a* by sliding relative to the frame 4.

Here, the motorized drive device 5 is configured to move only one of the first and second leaves 3*a*, 3*b* by sliding relative to the frame 4, in particular the first leaf 3*a*.

Here, and as illustrated in FIGS. 1 and 2, the second leaf 3*b* is movable manually, in particular by the user exerting a force on a handle 40 of the second leaf 3*b*.

Alternatively, the second leaf 3*b* is stationary.

The number of leaves of the window is not limiting and can be different, in particular equal to three.

Each leaf 3*a*, 3*b* comprises a frame 15. Each leaf 3*a*, 3*b* may also comprise at least one glass sheet 16 arranged in the frame 15.

The number of glass sheets of the leaf is not limiting and can be different, in particular equal to two or more.

The window 2 also comprises a bracket system arranged between the frame 4 and each leaf 3*a*, 3*b*.

The bracket system of a window is well known by those skilled in the art and does not need to be described in more detail here. The bracket system of the window 2 is not shown in FIGS. 1 and 2, so as to facilitate the reading of said figures.

The frame 4 includes an upper crosspiece 4*a*, a lower crosspiece, not shown, and two lateral uprights 4*c*, in the assembled configuration of the window 2 with respect to the building, as illustrated in FIGS. 1 and 2.

The upper crosspiece 4*a*, the lower crosspiece and the two lateral uprights 4*c* of the frame 4 respectively have an inner face and at least one outer face.

The inner face of the upper crosspiece 4*a*, the lower crosspiece and the two lateral uprights 4*c* of the frame 4 is oriented toward the inside of the window 2, and, in particular, toward an outer rim of the frame 15 of each leaf 3*a*, 3*b*.

The outer face of the upper crosspiece 4*a*, the lower crosspiece and the two lateral uprights 4*c* of the frame 4 is oriented toward the outside of the window 2.

The bracket system of the sliding window 2 makes it possible to slide each leaf 3*a*, 3*b* relative to the frame 4 along a sliding direction D, in the example horizontal, in the assembled configuration of the window 2 relative to the building, as illustrated in FIGS. 1 to 4.

The upper crosspiece 4*a* of the frame 4 comprises a sliding rail 11*a* of the leaf 3*a* and a sliding rail 11*b* of the leaf 3*b*. The lower crosspiece of the frame 4 also comprises two sliding rails, respectively for the leaf 3*a* and the leaf 3*b*.

Thus, each of the upper 4*a* and lower crosspieces of the frame 4 comprises a first sliding rail 11*a* or equivalent of the first leaf 3*a* and a second sliding rail 11*b* or equivalent of the second leaf 3*b*.

In this way, the first and second leaves 3*a*, 3*b* are configured to move respectively along first and second sliding rails 11*a*, 11*b* and the like.

In practice, the first and second sliding rails 11*a*, 11*b* are arranged parallel to one another. Furthermore, the first and second sliding rails 11*a*, 11*b* are offset relative to one another along the thickness E of the frame 4.

The window 2 comprises sliding elements, not shown, allowing the movement of each leaf 3*a*, 3*b* relative to the frame 4. The sliding elements are arranged inside the first and second sliding rails of the lower crosspiece.

In practice, the sliding elements comprise casters arranged below the first and second leaves 3*a*, 3*b*. The casters are configured to roll inside the first and second sliding rails of the lower crosspiece.

An open position by partial or maximal sliding of each leaf 3*a*, 3*b* relative to the frame 4 corresponds to an aeration position of the building.

The motorized drive device 5 makes it possible to move the first leaf 3*a*, automatically by sliding, relative to the frame 4, in particular between the maximum opening position by sliding of the first leaf 3*a* relative to the frame 4 and the closed position of the first leaf 3*a* relative to the frame 4.

Figure 3:
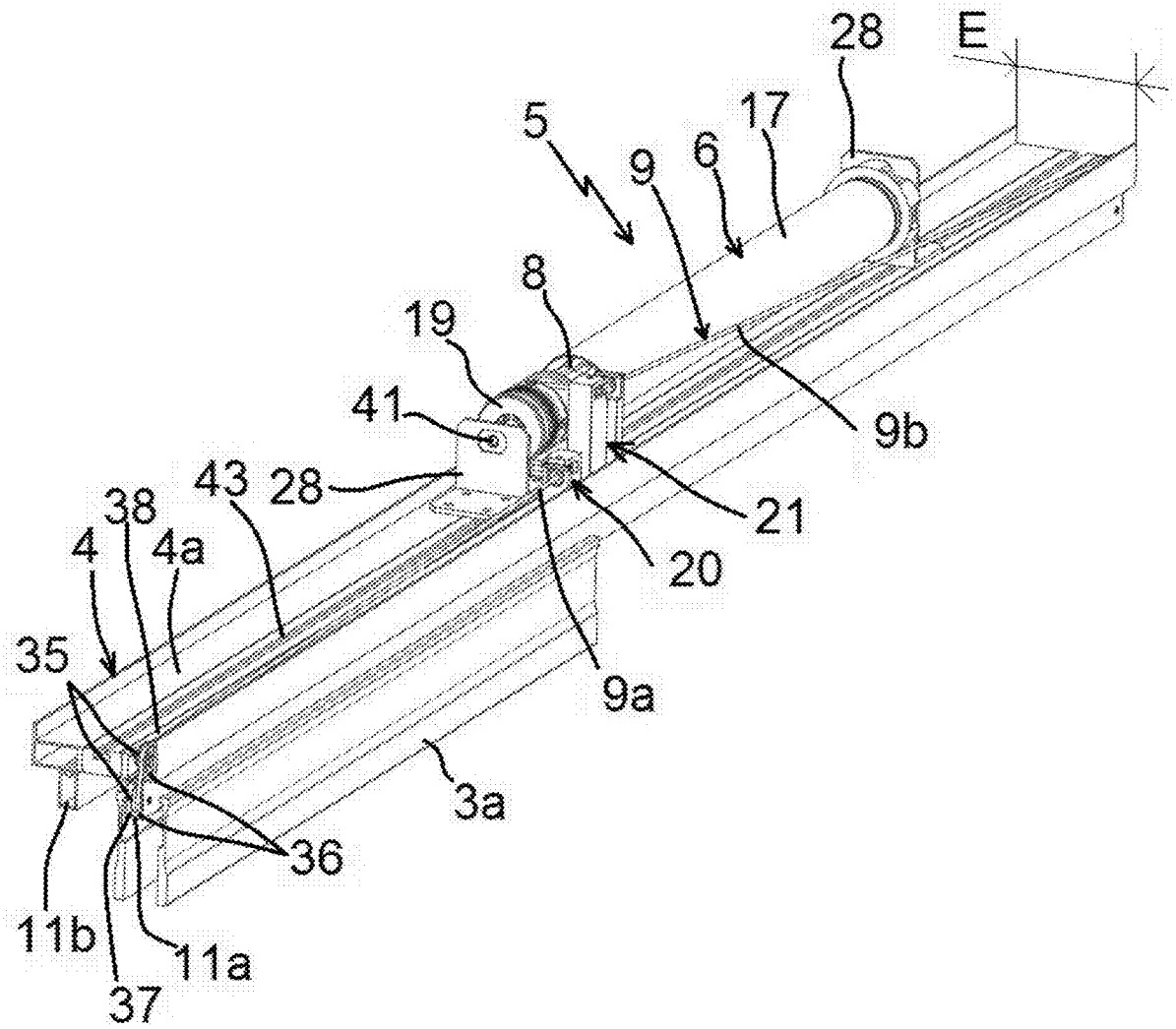
FIG. 3 is a schematic perspective view of a motorized drive device of the window illustrated in FIGS. 1 and 2, where the motorized drive device is assembled on an upper crosspiece of a frame of the window.

The motorized drive device 5 is more particularly visible in FIG. 3 and following. The latter comprises an electromechanical actuator 6, of the tubular type. The electromechanical actuator 6 comprises an electric motor 7 and an output shaft 8. The rotation axis X of the output shaft 8 is parallel to the sliding direction D of the first leaf 3*a* relative to the frame 4 and, in the present case, the second leaf 3*b* relative to the frame 4.

The electromechanical actuator 6 is arranged on a stationary part relative to the window 2, in particular relative to the frame 4.

The electromechanical actuator 6 may also comprise a gear reduction device, not shown.

The electromechanical actuator 6 may also comprise an end-of-travel and/or obstacle detection device, not shown. This detection device may be mechanical or electronic.

Advantageously, the electric motor 7 and, optionally, the gear reduction device are positioned inside a casing 17 of the electromechanical actuator 6.

Here, the electromechanical actuator 6 is of the tubular type.

The motorized drive device 5 also comprises a flexible element 9. The flexible element 9 is moved by the electrochemical actuator 6. The flexible element 9 comprises a first strand 9*a* and a second strand 9*b*.

The flexible element 9 may have a circular section.

The section of the flexible element is not limiting and may be different, in particular square, rectangular or oval.

In practice, the flexible element 9 is a cable or a cord.

It may be made from a synthetic material, for example nylon or polyethylene with a very high molar mass.

Thus, the use of a flexible element 9 made from a synthetic material makes it possible to minimize the diameter of pulleys of the motorized drive device 5.

The material of the flexible element is not limiting and may be different. In particular, it may be a steel.

Figure 4:
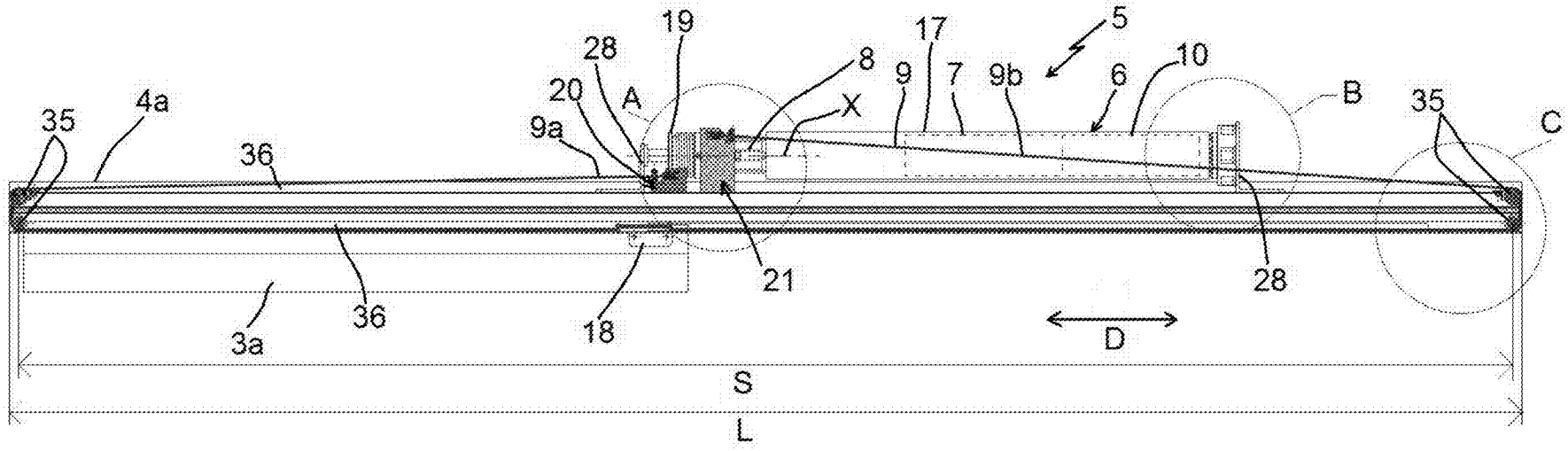
FIG. 4 is a schematic partial vertical sectional view of the motorized drive device of the window illustrated in FIG. 3.

The motorized drive device 5 comprises a carriage 18, as illustrated in FIG. 4. The carriage 18, is, on the one hand, attached on the first leaf 3*a*, and, on the other hand, connected to the flexible element 9.

Advantageously, the carriage 18 is arranged at least in part along the first sliding rail 11*a* of the upper crosspiece 4*a* of the frame 4.

In practice, the carriage 18 is attached on the first leaf 3*a* using fasteners, in particular screws, not shown.

Figure 8:
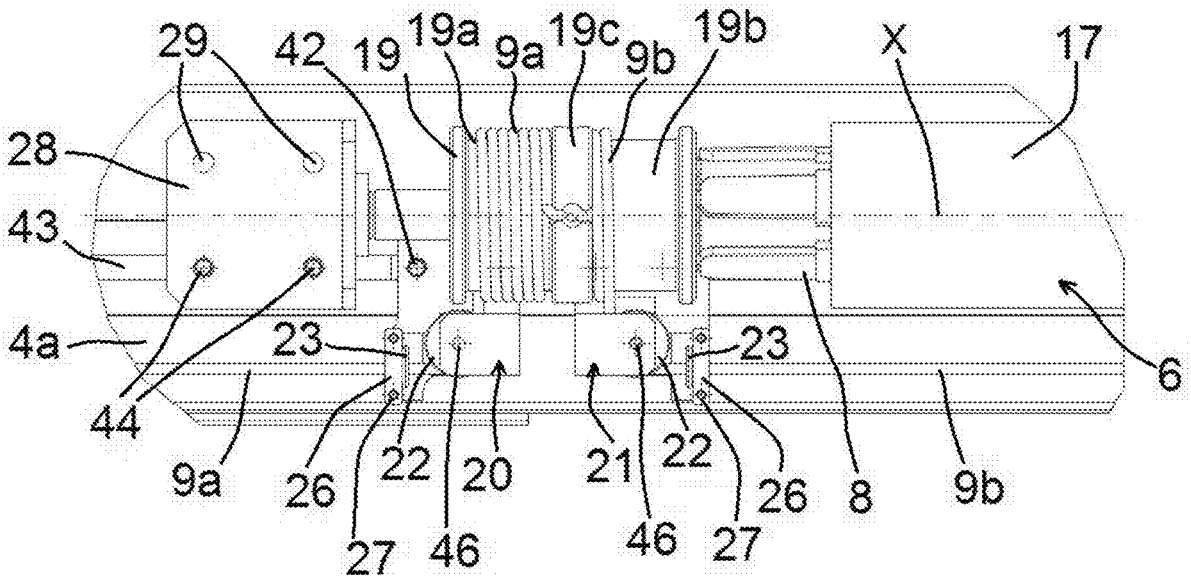
FIG. 8 is an enlarged schematic top view of part of the motorized drive device corresponding to detail A in FIG. 4.
Figure 9:
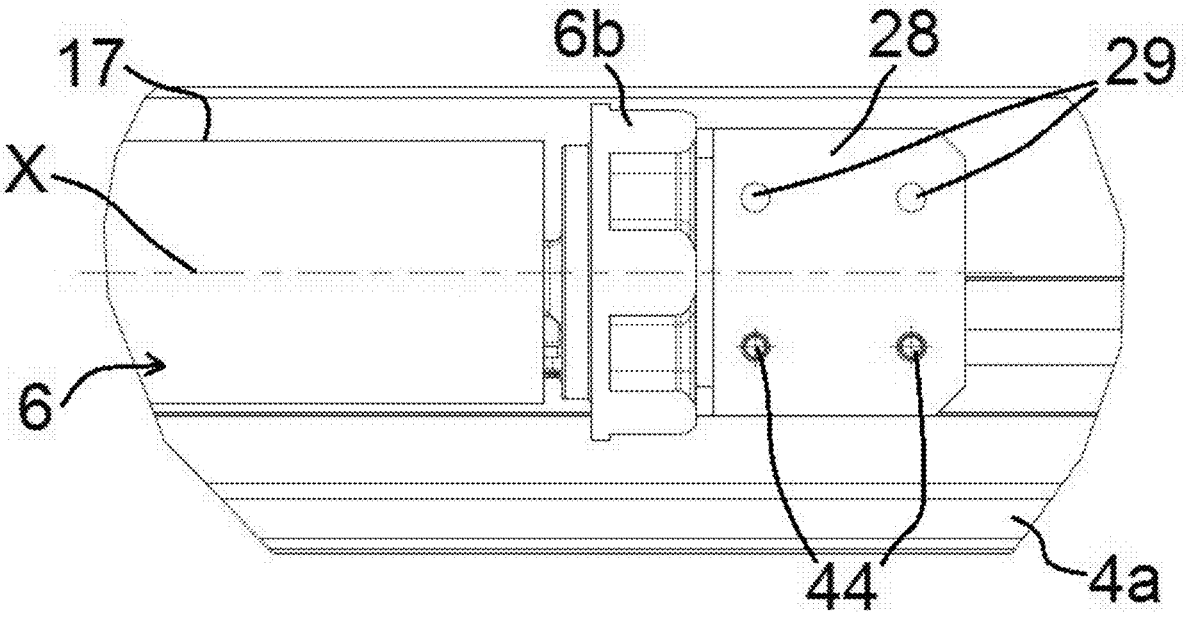
FIG. 9 is an enlarged schematic top view of part of the motorized drive device corresponding to detail B in FIG. 4.

The motorized drive device 5 comprises a winding pulley 19 of the flexible element 9. The winding pulley 19 is rotated by the output shaft 8 of the electromechanical actuator 6. One end of the first strand 9*a* of the flexible element 9 is connected to a first part 19*a* of the winding pulley 19. One end of the second strand 9*b* of the flexible element 9 is connected to a second part 19*b* of the winding pulley 19, as illustrated in FIGS. 6 and 8.

Figure 6:
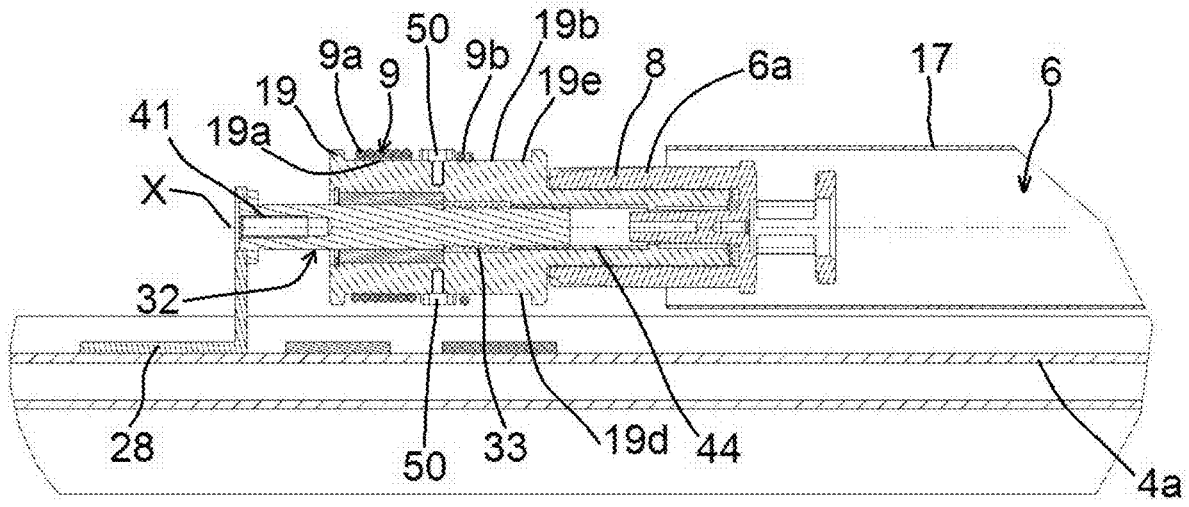
FIG. 6 is a schematic sectional view of the corresponding zone of detail A of FIG. 4, in a section plane parallel to that of FIGS. 4 and 5.

Advantageously, the end of each of the first and second strands 9*a*, 9*b* of the flexible element 9 is respectively attached to the first part 19*a* or to the second part 19*b* of the winding pulley 19 using fasteners 50, as illustrated in FIG. 6.

Thus, the end of each of the first and second strands 9*a*, 9*b* of the flexible element 9 is respectively fastened directly to the first part 19*a* or to the second part 19*b* of the winding pulley 19.

In practice, the fasteners 50 of the end of each of the first and second strands 9*a*, 9*b* of the flexible element 9 are cable-clamp elements.

Here and as illustrated in FIG. 6, these fasteners 50 are screws, in particular of the self-tapping type, screwing into the winding pulley 19, so as to attach the first and second strands 9*a*, 9*b* of the flexible element 9 by jamming between the head of the screws 50 and the winding surface of the flexible element 9 of the winding pulley 19. The winding, respectively unwinding, direction of the first strand 9*a* of the flexible element 9 around the first part 19*a* of the winding pulley 19 is opposite the winding, respectively unwinding, direction of the second strand 9*b* of the flexible element 9 around the second part 19*b* of the winding pulley 19.

Thus, during the movement of the first leaf 3*a* relative to the frame 4 in a first sliding direction, in particular during the movement from the closed position toward an open position of the first leaf 3*a* relative to the frame 4, the first strand 9*a* of the flexible element 9 winds around the first part 19*a* of the winding pulley 19, while the second strand 9*b* of the flexible element 9 unwinds around the second part 19*b* of the winding pulley 19.

Furthermore, during the movement of the first leaf 3*a* relative to the frame 4 in a second sliding direction, in particular during the movement from an open position toward the closed position of the first leaf 3*a* relative to the frame 4, the first strand 9*a* of the flexible element 9 unwinds around the first part 19*a* of the winding pulley 19, while the second strand 9*b* of the flexible element 9 winds around the second part 19*b* of the winding pulley 19.

The second sliding direction of the first leaf 3*a* relative to the frame 4 is opposite the first sliding direction.

In this way, the rotational driving direction of the first strand 9*a* of the flexible element 9 around the first part 19*a* of the winding pulley 19 is opposite the rotational driving direction of the second strand 9*b* of the flexible element 9 around the second part 19*b* of the winding pulley 19.

Advantageously, the sliding direction of the first leaf 3*a* relative to the frame 4 is determined based on the rotation direction of the output shaft 8 of the electromechanical actuator 6. Furthermore, the rotational driving direction of the winding pulley 19 is determined by the rotation direction of the output shaft 8 of the electromechanical actuator 6.

Thus, the rotational driving direction of the first strand 9*a* and the second strand 9*b* of the flexible element 9 around the first and second parts 19*a*, 19*b* of the winding pulley 19 depends on the rotation direction of the output shaft 8 of the electromagnetic actuator 6.

Here, the rotational driving direction of the winding pulley 19 is identical to the rotation direction of the output shaft 8 of the electromechanical actuator 6.

In practice, one of the first and second strands 9*a*, 9*b* of the flexible element 9 is relaxed as a function of the movement direction by sliding of the first leaf 3*a* relative to the frame 4, and, more particularly, as a function of the rotational driving direction of the winding pulley 19.

Thus, such an arrangement for the winding and unwinding of the first and second strands 9*a*, 9*b* of the flexible element 9 makes it possible to facilitate the setting of the length of the flexible element 9.

In one example embodiment, as illustrated in FIGS. 6 and 8, the first and second parts 19*a*, 19*b* of the winding pulley 19 are formed by a single part.

In such a case and as illustrated in FIG. 8, the winding pulley 19 may comprise a separating wall 19*c* between the first and second parts 19*a*, 19*b* thereof.

In an alternative that is not shown, the winding pulley 19 does not have such a separating wall between the first and second parts 19*a*, 19*b* thereof.

In an alternative that is not shown, the first and second parts 19*a*, 19*b* of the winding pulley 19 are formed by two separate parts.

In an alternative that is not shown, each of the first and second parts 19*a*, 19*b* of the winding pulley 19 is cone-shaped, so as to improve the guiding of the first and second strands 9*a*, 9*b* of the flexible element 9 respectively around the first and second parts 19*a*, 19*b* of the winding pulley 19.

Control means of the electromechanical actuator 6, allowing the sliding movement of the first leaf 3*a* relative to the frame 4, comprise at least one electronic control unit 10. The electronic control unit 10 is configured to operate the electric motor 7 of the electromechanical actuator 6, and, in particular, to allow the supply of electricity to the electric motor 7.

Thus, the electronic control unit 10 in particular commands the electric motor 7, so as to open or close the first leaf 3*a* relative to the frame 4 by sliding.

In this way, the window 2 comprises the electronic control unit 10. More particularly, the electronic control unit 10 is integrated into the motorized drive device 5.

Advantageously, the motorized drive device 5 is a sub-assembly preassembled before mounting, in the example on the frame 4, which comprises at least the electromechanical actuator 6, the winding pulley 19, the flexible element 9 and the electronic control unit 10.

The motorized drive device 5 is controlled by a control unit. The control unit may, for example, be a local control unit 12.

The local control unit 12 may be connected through a wired or wireless connection with a central control unit 13. The central control unit 13 drives the local control unit 12, as well as other similar local control units distributed throughout the building.

The electronic control unit 10 also comprises an order receiving module, in particular for radioelectric orders sent by an order transmitter, such as the local control unit 12 or the central control unit 13, said orders being intended to control the motorized drive device 5. The order receiving module can also allow the reception of orders sent by wired means.

The electronic control unit 10, the local control unit 12 and/or the central control unit 13 can be in communication with one or several sensors configured to determine, for example, a temperature, a hygrometry, a wind speed, a measurement of an indoor or outside air quality or a presence.

The central control unit 13 may also be in communication with a server 14, so as to control the electromechanical actuator 6 according to data made available remotely via a communication network, in particular an Internet network that may be connected to the server 14.

The electronic control unit 10 may be controlled from the local control unit 12. The local control unit 12 is provided with a control keyboard. The control keyboard of the local control unit 12 comprises selection elements, and, optionally, display elements.

As non-limiting examples, the selection elements may be pushbuttons or sensitive keys, the display elements may be light-emitting diodes, an LCD (Liquid Crystal Display) or TFT (Thin Film Transistor) display. The selection and display elements may also be produced using a touch-sensitive screen.

The local control unit 12 may be a stationary or nomad control point. A stationary control point corresponds to a control unit intended to be attached on a façade of a wall of the building, or on a face of the frame 4 of the window 2. A nomad control point corresponds to a remote control.

The local control unit 12 allows direct control of the electronic control unit 10 based on a selection made by the user.

The local control unit 12 allows the user to intervene directly on the electromechanical actuator 6 of the motorized drive device 5 using the electronic control unit 10 associated with said motorized drive device 5, or to intervene directly on the electromechanical actuator 6 of the motorized drive device 5 using the central control unit 13.

The motorized drive device 5, in particular the electronic control unit 10, is preferably configured to carry out closing command orders by sliding as well as opening by sliding of the first leaf 3*a* relative to the frame 4, said command orders being able to be emitted, in particular, by the local control unit 12 or by the central control unit 13.

The electronic control unit 10 is thus configured to operate the electromechanical actuator 6 of the motorized drive device 5, and, in particular, to allow the supply of electricity to the electromechanical actuator 6.

Here and as illustrated in FIG. 4, the electronic control unit 10 is positioned inside the casing 17 of the electromechanical actuator 6.

The control means of the electromechanical actuator 6 comprise hardware and/or software means.

As one non-limiting example, the hardware means may comprise at least one microcontroller.

Advantageously, the local control unit 12 comprises a sensor measuring at least one parameter of the environment inside the building and integrated into said unit.

Thus, the local control unit 12 can communicate with the central control unit 13, and the central control unit 13 can control the electronic control unit 10 associated with the motorized drive device 5 based on data coming from the sensor measuring the parameter of the environment inside the building.

Moreover, the local control unit 12 can directly control the electronic control unit 10 associated with the motorized drive device 5 based on data coming from the sensor measuring the parameter of the environment inside the building.

As non-limiting examples, one parameter of the environment inside the building measured by the sensor integrated into the local control unit 12 is the humidity, the temperature, the carbon dioxide level or the level of a volatile organic compound in the air.

Preferably, the activation of the local control unit 12 by the user has priority relative to the activation of the central control unit 13, so as to control the closing and opening by sliding of the first leaf 3*a* relative to the frame 4.

Thus, the activation of the local control unit 12 directly controls the electronic control unit 10 associated with the motorized drive device 5 based on a selection made by the user, optionally inhibiting a control order that may be sent by the central control unit 13 or a ignoring a value measured by a sensor measuring at least one parameter of the environment inside the building or outside the building, or a presence detection signal inside the building.

Here, the motorized drive device 5, in particular the electromechanical actuator 6, is supplied with electricity from an electricity supply grid. In such a case, the electromechanical actuator 6 comprises a power cable, not shown, allowing it to be supplied with electricity from the electricity supply grid of the sector.

Alternatively, the motorized drive device 5, in particular the electromechanical actuator 6, is supplied with electricity using a battery, not shown. In such a case, the battery can be recharged, for example, by a photovoltaic panel or any other energy recovery system, in particular, of the thermal type.

We will now describe, in reference to FIGS. 3 to 10, the integration of the motorized drive device 5 in the sliding window 2.

The winding pulley 19 and the output shaft 8 of the electromechanical actuator 6 have a same rotation axis X. In other words, the rotation axis of the winding pulley 19 is combined with the rotation axis X of the output shaft 8 of the electromechanical actuator 6.

Thus, the winding pulley 19 is arranged in the extension of the output shaft 8 of the electromechanical actuator 6 and is rotated around a same rotation axis X as the output shaft 8 of the electromechanical actuator 6.

The motorized drive device 5 further comprises a first angle transmission mechanism 20 cooperating with the first strand 9*a* of the flexible element 9, so as to guide the first strand 9*a* of the flexible element 9 relative to the first part 19*a* of the winding pulley 19, and a second angle transmission mechanism 21 cooperating with the second strand 9*b* of the flexible element 9, so as to guide the second strand 9*b* of the flexible element 9 relative to the second part 19*b* of the winding pulley 19.

Furthermore, the first and second strands 9*a*, 9*b* of the flexible element 9 are respectively guided using the first and second angle transmission mechanisms 20, 21 relative to the first and second parts 19*a*, 19*b* of the winding pulley 19.

In this way, the motorized drive device 5 is made compactly, while guaranteeing reliable operation of the window 2.

Furthermore, the flexible element 9 forms a so-called open loop between the end of the first strand 9*a* connected to the first part 19*a* of the winding pulley 19 and the end of the second strand 9*b* connected to the second part 19*b* of the winding pulley 19.

In this way, the first and second strands 9*a*, 9*b* of the flexible element 9 are connected to the winding pulley 19 and separated at the first and second parts 19*a*, 19*b* thereof.

The use of the flexible element 9, of the cable or cord type, with the first and second angle transmission mechanisms 20, 21 makes it possible to position the winding mechanism 19 in the extension of the output shaft 8 of the electromechanical actuator 6 and to align the electromechanical actuator 6 with the winding pulley 19, along the length L of the upper crosspiece 4*a* of the frame 4, so as to minimize the bulk of the motorized drive device 5.

Advantageously, the first angle transmission mechanism 20 is arranged opposite the first part 19*a* of the winding pulley 19. Furthermore, the second angle transmission mechanism 21 is arranged opposite the second part 19*b* of the winding pulley 19.

Thus, the travel and guiding of the first and second strands 9*a*, 9*b* of the flexible element 9 are simplified.

Here and as illustrated in FIG. 8, the first and second angle transmission mechanisms 20, 21 are arranged on a same side of the rotation axis X, along the thickness E of the upper crosspiece 4*a*.

Preferably, each of the first and second angle transmission mechanisms 20, 21 comprises an angle transmission pulley 22 of one of the first and second strands 9*a*, 9*b* of the flexible element 9.

Advantageously, each of the first and second angle transmission mechanisms 20, 21 also comprises a guide element 23 of one of the first and second strands 9*a*, 9*b* of the flexible element 9. Furthermore, the guide element 23 and the angle transmission pulley 22 of each of the first and second angle transmission mechanisms 20, 21 are configured to cooperate with one another, so as to guide one of the first and second strands 9*a*, 9*b* of the flexible element 9.

Figure 5:
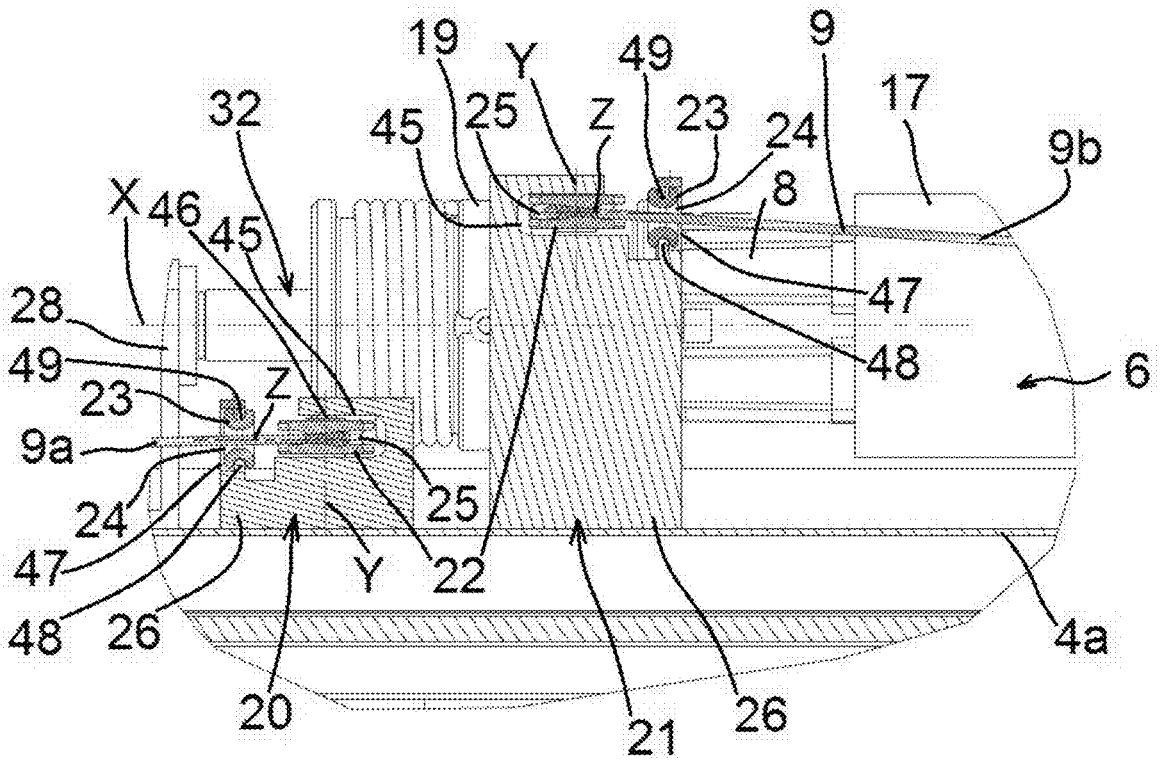
FIG. 5 is an enlarged view of detail A of FIG. 4.

In the example embodiment illustrated in FIGS. 3 to 5, the first and second strands 9*a*, 9*b* of the flexible element 9 extend in opposite directions, from first and second angle transmission mechanisms 20, 21, and, more particularly, from each angle transmission pulley 22 of the first and second angle transmission mechanisms 20, 21.

Here and as illustrated in FIG. 5, the guide element 23 of each of the first and second angle transmission mechanisms 20, 21 is a guide ring.

For each of the first and second angle transmission mechanisms 20, 21, the guide ring 23 comprises a passage opening 24 of the flexible element 9. The passage opening 24 of the guide ring 23 is arranged opposite a groove 25 of the angle transmission pulley 22 of the angle transmission mechanism 20, 21, so as to guide the flexible element 9.

Here and as illustrated in FIGS. 5 and 6, the angle transmission pulley 22, as well as the guide element 23, of the first angle transmission mechanism 20 are arranged opposite a lower winding zone of the first part 19*a* of the winding pulley 19. Furthermore, the angle transmission pulley 22, as well as the guide element 23, of the second angle transmission mechanism 21 are arranged opposite an upper winding zone of the second part 19*b* of the winding pulley 19.

Moreover, for each of the first and second angle transmission mechanisms 20, 21, a rotation axis Y of the angle transmission pulley 22 is perpendicular to an axis Z of the passage opening 24 of the guide element 23 of the same angle transmission mechanism 20, 21.

In practice, each of the first and second angle transmission mechanisms 20, 21 also comprises a support 26.

Advantageously, the support 26 of each of the first and second angle transmission mechanisms 20, 21 is fastened on the upper crosspiece 4*a* of the frame 4 by screwing.

In practice, each support 26 comprises at least one passage hole 27 for a fastening screw. In the example embodiment and as illustrated in FIG. 8, each support 26 comprises two passage holes 27 for a fastening screw.

Furthermore, a fastening screw passing through a passage hole 27 is screwed in the upper crosspiece 4*a* of the frame 4, in particular in a screwing opening arranged in the upper crosspiece 4*a* of the frame 4. In practice, this fastening screw is of the self-tapping type.

Advantageously, each support 26 comprises a pin 42 cooperating with a slot 43 arranged in the upper crosspiece 4*a* of the frame 4, as illustrated in FIG. 8 for the first angle transmission mechanism 20.

Thus, each support 26 is oriented and positioned relative to the upper crosspiece 4*a* of the frame 4.

The angle transmission pulley 22 of each of the first and second angle transmission mechanisms 20, 21 can, for example, be made by a loose pulley, in other words mounted freely rotating around its rotation axis Y, in particular on the support 26 of the angle transmission mechanism 20, 21, or by a stationary pulley, in other words secured on its axis, in particular fastened on the support 26 of the angle transmission mechanism 20, 21.

In practice, each support 26 comprises elements for maintaining the angle transmission pulley 22, in particular a housing 45 and a rotation shaft 46, as illustrated in FIGS. 5 and 8. The rotation shaft 46 extends through the angle transmission pulley 22, in particular in the central part thereof. Furthermore, each support 26 comprises elements for maintaining the guide element 23, in particular a housing 47. The housing 47 comprises a rim 48 cooperating with the groove 49 arranged on the outer contour of the guide element 23, so as to keep the guide element 23 in position in the housing 47, as illustrated in FIG. 5.

Preferably, the electromechanical actuator 6 is attached on the upper crosspiece 4*a* of the frame 4 using fasteners 28.

Thus, the motorized drive device 5 is configured to be implemented on a sliding window 2 comprising a frame 4 provided with a lower crosspiece and standard lateral uprights 4*c*.

Furthermore, the winding pulley 19 is maintained through same fasteners 28.

Advantageously, the electromechanical actuator 6 is positioned near one end of the upper crosspiece 4*a* of the frame 4.

Thus, the positioning of the electromechanical actuator 6 near one end of the upper crosspiece 4*a* of the frame 4 makes it possible to limit the sagging of the upper crosspiece 4*a* due to the weight of the electromechanical actuator 6, in particular relative to a central positioning of the electromechanical actuator 6 on the upper crosspiece 4*a*, along the length L thereof.

In practice, the fasteners 28 of the electromechanical actuator 6 on the upper crosspiece 4*a* of the frame 4 comprise supports, in particular fastening brackets.

Advantageously, these supports 28 are fastened on the upper crosspiece 4*a* of the frame 4 by screwing.

In practice, each support 28 comprises at least one passage hole 29 for a fastening screw. In the example embodiment illustrated in FIGS. 8 and 9, each support 28 comprises two passage holes 29 for a fastening screw.

Furthermore, a fastening screw passing through a passage hole 29 is screwed in the upper crosspiece 4*a* of the frame 4, in particular in a screwing opening arranged in the upper crosspiece 4*a* of the frame 4. In practice, this fastening screw is of the self-tapping type.

Here, the fasteners 28 of the electromechanical actuator 6 on the upper crosspiece 4*a* of the frame 4 comprise two supports. A first support 28 is assembled at a first end 6*a* of the electromechanical actuator 6. A second support 28 is assembled at a second end 6*b* of the electromechanical actuator 6. The first end 6*a* of the electromechanical actuator 6 is opposite the second end 6*b* of the electromechanical actuator 6.

Advantageously, each support 28 comprises at least one pin 44 cooperating with the slot 43 arranged in the upper crosspiece 4*a* of the frame 4. In the example embodiment illustrated in FIGS. 8 and 9, each support 28 comprises two pins 44.

Thus, each support 28 is oriented and positioned relative to the upper crosspiece 4*a* of the frame 4.

Advantageously, each support 28 may comprise a vibration damping element, not shown, in particular an elastomeric element, positioned between the upper crosspiece 4*a* of the frame 4 and the electromechanical actuator 6, during the fastening of the support 28 on the upper crosspiece 4*a* of the frame 4.

Figure 7:
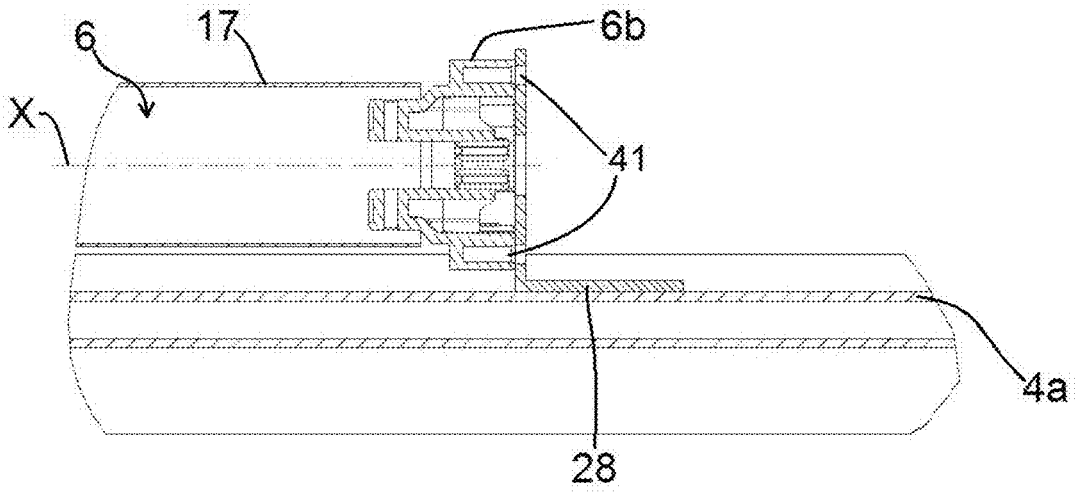
FIG. 7 is an enlarged schematic sectional view of detail B of FIG. 4.

Advantageously, the fastening of the electromechanical actuator 6, as well as the winding pulley 19, on the supports 28 is implemented by fasteners 41, in particular by screwing, as illustrated in FIGS. 3, 6 and 7.

Alternatively, the fasteners of the electromechanical actuator 6, as well as the winding pulley 19, on the supports 28 are resilient snapping elements.

Figure 10:
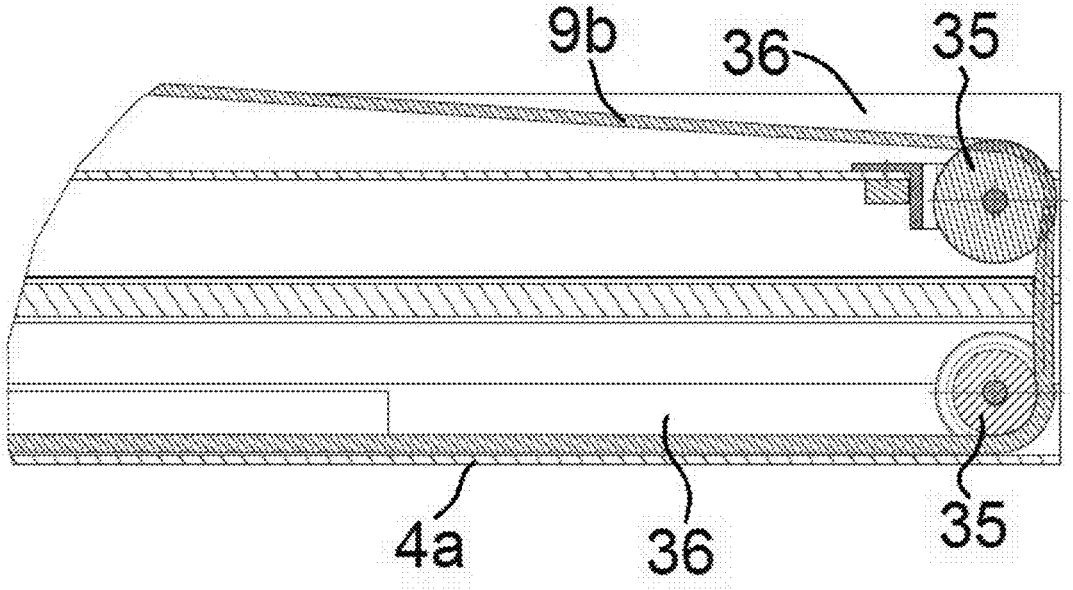
FIG. 10 is an enlarged schematic sectional view of detail C of FIG. 4.

Here and as illustrated in FIGS. 3, 4 and 10, the flexible element 9 of the motorized drive device 5 extends along the upper crosspiece 4*a* of the frame 4 from the first part 19*a* of the winding pulley 19 to the second part 19*b* of the winding pulley 19.

Thus, such an arrangement of the flexible element 9 makes it possible to guarantee the movements by sliding of the first leaf 3*a* relative to the frame 4, as well as the esthetic appearance of the window 2.

Here and as illustrated in FIGS. 3 and 4, the flexible element 9 extends, on the one hand, from the side of the upper face of the upper crosspiece 4*a*, and, on the other hand, from the side of a lower face of the upper crosspiece 4*a*, along at least part of the length L of the upper crosspiece 4*a* of the frame 4.

In practice, the motorized drive device 5 comprises at least two angle transmission pulleys 35 separated by a determined distance S along the length L of the upper crosspiece 4*a*.

At least a first angle transmission pulley 35 is arranged on a first side of the electromechanical actuator 6, i.e., the first end 6*a* of the electromechanical actuator 6. At least a second angle transmission pulley 35 is arranged on a second side of the electromechanical actuator 6, i.e., the second end 6*b* of the electromechanical actuator 6.

Here, the motorized drive device 5 comprises two pairs of angle transmission pulleys 35 separated by the determined distance S.

The number of angle transmission pulleys is not limiting and may be different.

Advantageously, the determined distance S between the angle transmission pulleys 35 is different from the sliding movement travel of the first leaf 3*a*.

Preferably, in the case where the motorized drive device 5 is configured to move a single leaf 3*a* by sliding using the flexible element 9, the determined separation S between the angle transmission pulleys 35 is greater than or equal to half the length L of the upper crosspiece 4*a*.

Each angle transmission pulley 35 can, for example, be made by a loose pulley, in other words mounted freely rotating, in particular on the upper crosspiece 4*a* of the frame 4, or by a stationary pulley, in other words secured to its axis, in particular fastened on the upper crosspiece 4*a* of the frame 4.

Advantageously, the upper crosspiece 4*a* of the frame 4 comprises at least one guide element 36 of the flexible element 9 extending along the length L of the upper crosspiece 4*a*.

In practice, a first guide element 36 of the flexible element 9 extends from the side of the lower face of the upper crosspiece 4*a* and a second guide element 36 extends from the side of the upper face of the upper crosspiece 4*a*, as illustrated in FIGS. 3, 4 and 10.

Preferably, the first and second guide elements 36 are formed by a cavity arranged inside the upper crosspiece 4*a*.

Thus, the flexible element 9 occupies a position hidden inside the first and second guide elements 36 formed by a cavity.

In this way, the flexible element 9 is protected from wear, the risks of jamming thereof with the sliding elements of the first leaf 3*a* relative to the frame 4 and break-in attempts.

In the illustrated example, each cavity arranged inside the upper crosspiece 4*a* emerges only at the two longitudinal ends. Alternatively, at least one of these cavities emerges at a lateral opening of the upper crosspiece 4*a*.

Furthermore, the integration of the cavities arranged inside the upper crosspiece 4*a* thus makes it possible to guide and maintain the flexible element 9, in particular the first strand 9*a* or the second strand 9*b* of the flexible element 9, which is relaxed as a function of the rotational driving direction of the winding pulley 19.

Here and as illustrated in FIG. 3, the first guide element 36 comprises a chute 37 arranged inside the first sliding rail 11*a* of the upper crosspiece 4*a*.

In an alternative that is not shown, the guide element 36 comprises a chute arranged outside the first sliding rail 11*a* of the upper crosspiece 4*a*.

Advantageously, the second guide element 36 is formed by a recess 38 of the upper crosspiece 4*a* of the frame 4 housing the electromechanical actuator 6 and the winding pulley 19. The recess 38 extends along the length L of the upper crosspiece 4*a*.

Thus, the flexible element 9 occupies a position hidden inside the second guide element 36 formed by the recess 38.

As illustrated in FIGS. 1 and 2, the electromechanical actuator 6 and the winding pulley 19 are positioned in a box 30 arranged above the window 2, in particular extending above the upper crosspiece 4*a* of the frame 4.

Thus, the electromechanical actuator 6 and the winding pulley 19 are hidden in the box 30, so as to guarantee the esthetically pleasing appearance of the sliding window 2.

Advantageously, the window 2 comprises an access hatch 31 to the motorized drive device 5, and, more particularly, to the electromechanical actuator 6 and the winding pulley 19.

Thus, the access hatch 31 makes it possible to perform a maintenance operation of the motorized drive device 5 and/or a repair operation thereof.

Here and as illustrated in FIGS. 1 and 2, the access hatch 31 extends over the entire length L of the upper crosspiece 4*a* of the frame 4.

Alternatively, the access hatch 31 extends over part of the length L of the upper crosspiece 4*a* of the frame 4.

Here and as illustrated in FIGS. 1 and 2, the access hatch 31 is arranged in the box 30.

Alternatively, the access hatch 31 is arranged in the upper crosspiece 4*a* of the frame 4, in particular through the first sliding rail 11*a* of the upper crosspiece 4*a* or between the first and second sliding rails 11*a*, 11*b* of the upper crosspiece 4*a*.

Advantageously, the electromechanical actuator 6 and the winding pulley 19 are assembled on the frame 4, in particular on the upper crosspiece 4*a*, using the first support 28 and the second support 28. Furthermore, a mechanism 32, forming a slider connection along the rotation axis X, is arranged between, on the one hand, one of the first and second supports 28, and, on the other hand, the winding pulley 19 or one end 6*a*, 6*b* of the electromechanical actuator 6.

Thus, the winding pulley 19 or the electromechanical actuator 6, or both of the latter together, can be moved along the rotation axis X using the mechanism 32 between the first and second supports 28.

In this way, the turns of the first and second strands 9*a*, 9*b* of the flexible element 9 around the first and second parts 19*a*, 19*b* of the winding pulley 19 are distributed uniformly and while avoiding overlapping one another.

Here and as illustrated in FIGS. 5 and 6, the mechanism 32 is made through the winding pulley 19 and between one of the supports 28 and the end 6*a* of the electromechanical actuator 6.

In the example embodiment illustrated in FIGS. 5 and 6, the winding pulley 19 is fastened to the output shaft 8 of the electromechanical actuator 6 via the mechanism 32.

Advantageously, the output shaft 8 of the electromechanical actuator 6 is connected to the winding pulley 19 using the mechanism 32 of the screw-nut type, so as to rotate and translate the winding pulley 19, during the rotational driving of the output shaft 8 of the electromechanical actuator 6.

Thus, the winding pulley 19 is rotated by the output shaft 8 of the electromechanical actuator 6 and translated by the screw-nut mechanism 32, during the activation of the electromechanical actuator 6.

In this way, the turns of the first and second strands 9*a*, 9*b* of the flexible element 9 around the first and second parts 19*a*, 19*b* of the winding pulley 19 are distributed uniformly and while avoiding overlapping one another.

Here and as illustrated in FIGS. 5 and 6, the screw-nut mechanism 32 is fastened, on the one hand, to the output shaft 8 of the electromechanical actuator 6, and, on the other hand, to one of the supports 28 of the electromechanical actuator 6.

Furthermore, the output shaft 8 of the electromechanical actuator 6 is connected to a threaded screw 33 cooperating with a tapped hole 34 arranged inside the winding pulley 19.

In an alternative that is not shown, the winding pulley 19 is fastened directly to the output shaft 8 of the electromechanical actuator 6.

Advantageously, the only leaf 3*a*, from among the first and second leaves 3*a*, 3*b*, that is able to be slid by the motorized drive device 5, is an interior leaf of the window 2. The interior leaf 3*a* is arranged on the interior side relative to the building, in the assembled configuration of the window 2 in the building.

Thus, the flexible element 9 allowing the driving by sliding of the first leaf 3*a* relative to the frame 4 is kept inaccessible from the outside of the building, and, more particularly, of the window 2, when the first leaf 3*a* is in a closed or secured ventilation position relative to the frame 4.

The secured ventilation position is a position of the first leaf 3*a* relative to the frame 4 in which the first leaf 3*a* is ajar relative to the frame 4 and kept locked by a locking mechanism, not shown.

Furthermore, in the case where the second leaf 3*b* is movable manually, the latter can be moved by the user independently of the first leaf 3*a*, in particular if there is no power supply of the motorized drive device 5 or a failure of the motorized drive device 5.

The motorized drive device 5 makes it possible to slide the first leaf 3*a* automatically relative to the frame 4 along the sliding direction D, by winding, respectively unwinding, the first strand 9*a* of the flexible element 9 around the first part 19*a* of the winding pulley 19 and unwinding, respectively winding, the second strand 9*b* of the flexible element 9 around the second part 19*b* of the winding pulley 19.

The motorized drive device 5 makes it possible to close and open the first leaf 3*a* in a motorized manner relative to the frame 4, by sliding along the sliding direction D.

Advantageously, in case of failure of the motorized drive device 5, a manual sliding, in particular by the user, of the first leaf 3*a* relative to the frame 4 along the sliding direction D can be implemented, following the separation of the flexible element 9 relative to the first leaf 3*a*.

Furthermore, the use of the flexible element 9 to move the first leaf 3*a* relative to the frame 4 makes it possible to minimize the costs of obtaining the motorized drive device 5, and to minimize the bulk of the motorized drive device 5, in particular relative to a belt.

Here, the flexible element 9 made up of the first and second strands 9*a*, 9*b* is made in a single part. In such a case, the flexible element 9 extends from the first part 19*a* of the winding pulley 19 to the second part 19*b* of the winding pulley 19.

In an alternative that is not shown, the first strand 9*a* of the flexible element 9 comprises another end connected to a locking and unlocking mechanism of the first leaf 3*a* relative to the frame 4. Furthermore, the second strand 9*b* of the flexible element 9 comprises another end connected to the locking and unlocking mechanism.

The other end of the first strand 9*a* of the flexible element 9 is opposite the end of the first strand 9*a* of the flexible element 9 connected to the first part 19*a* of the winding pulley 19. Furthermore, the other end of the second strand 9*b* of the flexible element 9 is opposite the end of the second strand 9*b* of the flexible element 9 connected to the second part 19*b* of the winding pulley 19.

Thus, the flexible element 9 is made in two parts. The first part of the flexible element 9 is formed by the first strand 9*a* extending between the first part 19*a* of the winding pulley 19 and the locking and unlocking mechanism. Furthermore, the second part of the flexible element 9 is formed by the second strand 9*b* extending between the second part 19*b* of the winding pulley 19 and the locking and unlocking mechanism.

The motorized drive device 5 can be controlled by the user, for example by receiving a command order corresponding to pressing on a selection element of the local control unit 12, such as a remote control unit or a stationary control point.

The motorized drive device 5 can also be controlled automatically, for example by receiving a command order corresponding to at least one signal coming from at least one sensor and/or to a signal coming from a clock. The sensor and/or the clock can be integrated into the local control unit 12 or the central control unit 13.

Advantageously, the motorized drive device 5 makes it possible to move the first leaf 3*a* automatically by sliding relative to the frame 4 to a predetermined position, between the closed position and the maximal position. The movement by sliding of the first leaf 3*a* relative to the frame 4 to the predetermined position, in particular partial opening or closing, is carried out after receiving a command order emitted by the local control unit 12, the central control unit 13 or a sensor.

Here, a movement by sliding of the first leaf 3*a* relative to the frame 4 in the sliding direction D is carried out by supplying electricity to the electromechanical actuator 6, so as to unwind or wind the first and second strands 9*a*, 9*b* of the flexible element 9 around the first and second parts 19*a*, 19*b* of the winding pulley 19.

Thus, the unwinding or winding of the first and second strands 9*a*, 9*b* of the flexible element 9 around the first and second parts 19*a*, 19*b* of the winding pulley 19 is controlled by supplying electricity to the electromechanical actuator 6.

In practice, the supply of electricity to the electromechanical actuator 6 is controlled by a command order received by the electronic control unit 10 coming from the local control unit 12, the central control unit 13 or a sensor.

Figure 11:
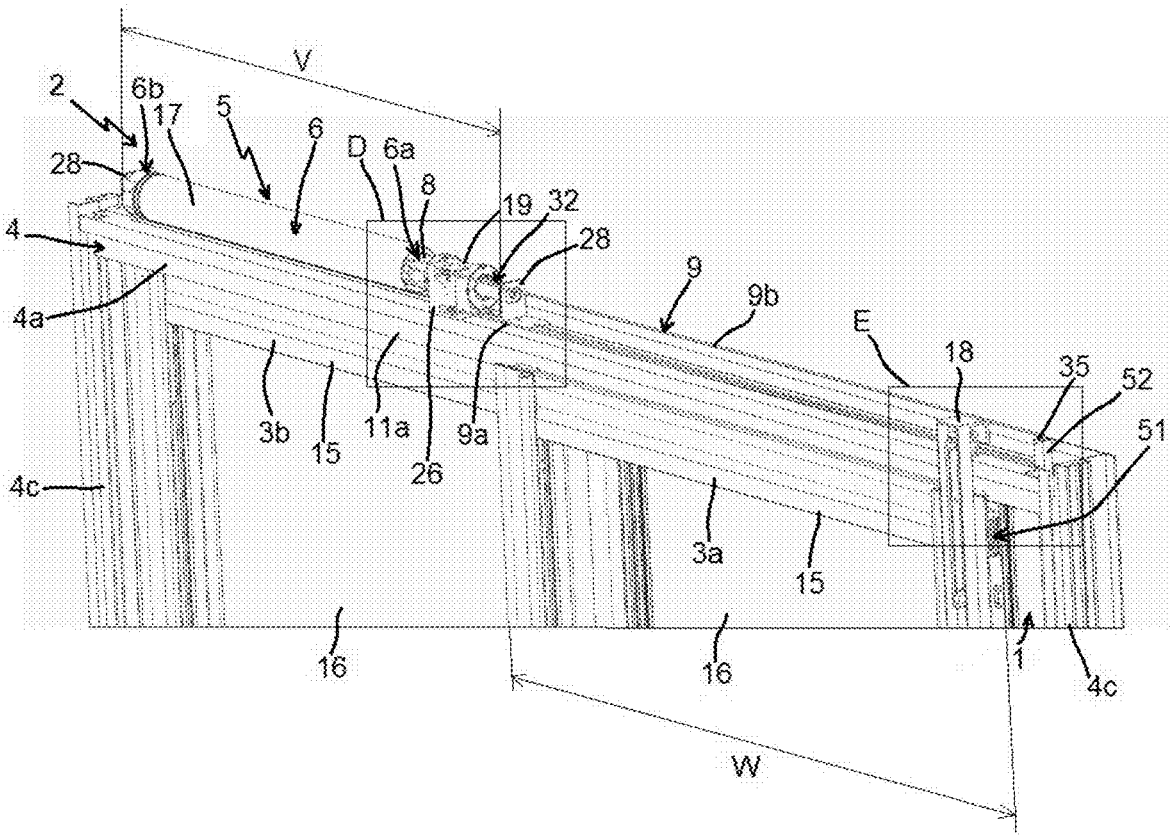
FIG. 11 is a partial schematic perspective view of a sliding window according to a second embodiment, where the first leaf is in a partial open position relative to the frame and where the box has been omitted.
Figure 12:
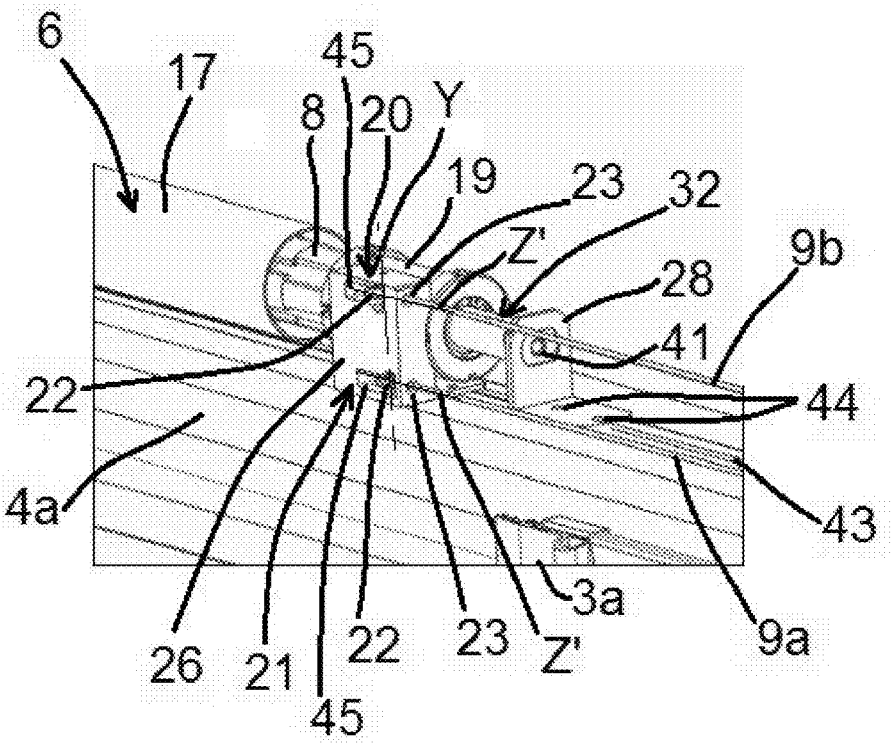
FIG. 12 is an enlarged view of detail D of FIG. 11.
Figure 13:
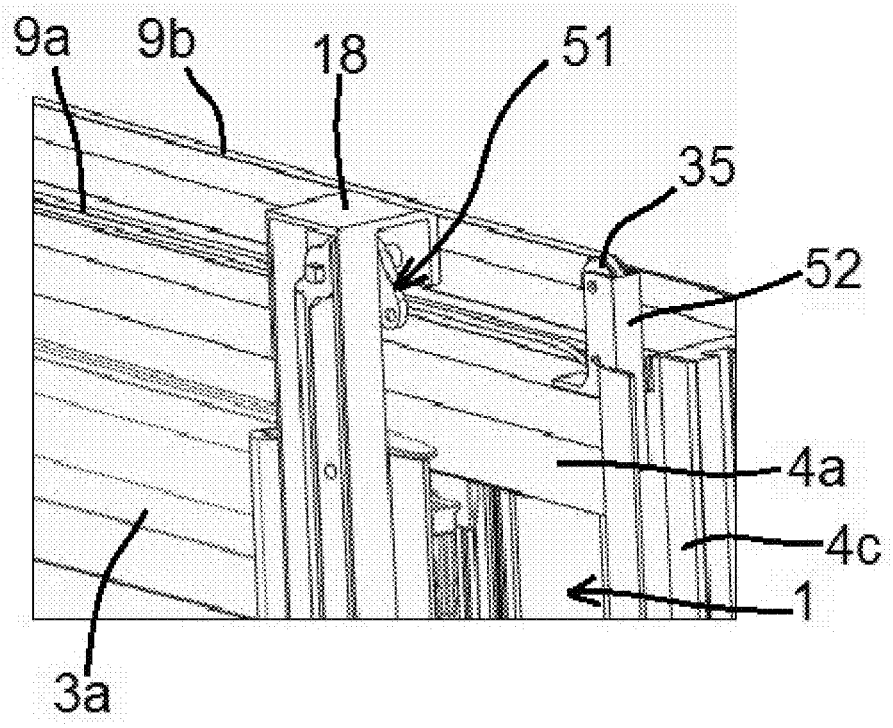
FIG. 13 is an enlarged view of detail E of FIG. 11.

In a second embodiment, shown in FIGS. 11 to 13, the elements similar to those of the first embodiment previously described bear the same references and operate as explained above. Hereinafter, we mainly describe only what distinguishes this embodiment from the previous one. Hereinafter, when a reference sign is used without being reproduced in one of FIGS. 11 to 13, it corresponds to the object bearing the same reference in one of FIGS. 1 to 10.

We now describe, in reference to FIGS. 11 to 13, the integration of the motorized drive device 5 in the sliding window 2, according to the second embodiment.

Here and similarly to the first embodiment, each of the first and second angle transmission mechanisms 20, 21 comprises an angle transmission pulley 22 of one of the first and second strands 9*a*, 9*b* of the flexible element 9.

Furthermore, each of the first and second angle transmission mechanisms 20, 21 also comprises a guide element 23 of one of the first and second strands 9*a*, 9*b* of the flexible element 9.

Here, the first and second strands 9*a*, 9*b* of the flexible element 9 extend in a same direction, from first and second angle transmission mechanisms 20, 21 and, more particularly, from each angle transmission pulley 22 of the first and second angle transmission mechanisms 20, 21.

Advantageously, the carriage 18 is fastened on the frame 15 of the first leaf 3*a*, and, more particularly, on a lateral upright of the frame 15 configured to cooperate with a lateral upright 4*c* of the frame 4, in the closed position of the first leaf 3*a* relative to the frame 4.

Furthermore, the carriage 18 is fastened on an upper part of the frame 15 of the first leaf 3*a*, in the assembled configuration of the window 2 with respect to the building.

The fastening of the carriage 18 on the frame 15 of the first leaf 3*a* can be carried out by fastening elements by screwing.

Here and as illustrated in FIG. 11, the electromechanical actuator 6 is assembled on the upper crosspiece 4*a* of the frame 4 on the side opposite the first leaf 3*a*, when the first leaf 3*a* is in the closed position relative to the frame 4.

Thus, the first leaf 3*a*, and, more particularly the carriage 18, can be arranged so as not to move opposite the electromechanical actuator 6 and the winding pulley 19. To that end, the length V, measured parallel to the movement direction of the first leaf 3*a*, of the assembly formed by the electromechanical actuator 6 and the winding pulley 19, including the screw-nut mechanism 32 forming a slider connection if the latter is present, must be smaller than the width W of the first leaf 3*a*, measured parallel to the same direction.

In this way, the bulk of the motorized drive device 5 is minimized, and, in particular, still more significantly relative to the embodiment previously described.

Here, the first angle transmission mechanism 20 cooperating with the first strand 9*a* of the flexible element 9 and the second angle transmission mechanism 21 cooperating with the second strand 9*b* of the flexible element 9 are made through the same support 26.

In this example embodiment, the angle transmission pulley 22 of each of the first and second angle transmission mechanisms 20, 21 can, for example, be made by a loose pulley, in other words mounted freely rotating around its rotation axis Y, in particular on the support 26 of the angle transmission mechanism 20, 21, or by a stationary pulley, in other words secured on its axis, in particular fastened on the support 26 of the angle transmission mechanism 20, 21.

Here and as illustrated in FIGS. 11 and 12, the guide element 23 of each of the first and second angle transmission mechanisms 20, 21 is a passage hole arranged in the support 26.

The passage hole forming the guide element 23 is arranged opposite the groove 25 of the angle transmission pulley 22 of the angle transmission mechanism 20, 21, so as to guide the flexible element 9.

Moreover, for each of the first and second angle transmission mechanisms 20, 21, the rotation axis Y of the angle transmission pulley 22 is perpendicular to an axis Z' of the passage hole forming the guide element 23 of the same angle transmission mechanism 20, 21.

Advantageously, the support 26 of the first and second angle transmission mechanisms 20, 21 is fastened on the upper crosspiece 4*a* of the frame 4, in particular by screwing.

Here, the motorized drive device 5 comprises only two angle transmission pulleys 35 arranged on the first side of the electromechanical actuator 6, i.e., the first end 6*a* of the electromechanical actuator 6. Only one of these pulleys 35 is visible in FIGS. 11 and 13.

Thus, in this embodiment, the motorized drive device 5 is made by doing away with the angle transmission pulley(s) 35 arranged on the second side of the electromechanical actuator 6, i.e., the second end 6*b* of the electromechanical actuator 6.

In this way, the number of angle transmission pulleys 35 is lower in this embodiment, relative to the embodiment previously described.

The number of angle transmission pulleys is not limiting and may be different. In particular, the motorized drive device may comprise a single angle transmission pulley arranged on the first side of the electromechanical actuator, i.e., the first end of the electromechanical actuator.

Here and as illustrated in FIGS. 11 and 13, the angle transmission pulleys 35 are assembled on a support 52. The support 52 is fastened on the upper crosspiece 4*a* of the frame 4, in particular by screwing.

Each angle transmission pulley 35 can, for example, be made by a loose pulley, in other words mounted freely rotating, in particular on the support 52, or by a stationary pulley, in other words secured to its axis, in particular fastened on the support 52.

In this example embodiment, the electromechanical actuator 6 and the flexible element 9 are positioned in the box 30, not shown in FIGS. 11 to 13, arranged above the window 2, in particular extending above the upper crosspiece 4*a* of the frame 4.

Thus, the electromechanical actuator 6 and the flexible element 9 are hidden in the box 30, so as to guarantee the esthetically pleasing appearance of the sliding window 2.

Likewise, the winding pulley 19 is positioned in the box 30 arranged above the window 2.

Here and like in the embodiment previously described, in reference to FIGS. 6 to 8, one end of the first strand 9*a* of the flexible element 9 is connected to the first part 19*a* of the winding pulley 19. One end of the second strand 9*b* of the flexible element 9 is connected to the second part 19*b* of the winding pulley 19.

Furthermore, in this second embodiment, the first strand 9*a* of the flexible element 9 comprises another end connected to a locking and unlocking mechanism 51 of the first leaf 3*a* relative to the frame 4. Furthermore, the second strand 9*b* of the flexible element 9 comprises another end connected to the locking and unlocking mechanism 51.

The other end of the first strand 9*a* of the flexible element 9 is opposite the end of this first strand 9*a* of the flexible element 9 connected to the first part 19*a* of the winding pulley 19. Furthermore, the other end of the second strand 9*b* of the flexible element 9 is opposite the end of this second strand 9*b* of the flexible element 9 connected to the second part 19*b* of the winding pulley 19.

Thus, the flexible element 9 is made in two parts. The first part of the flexible element 9 is formed by the first strand 9*a* extending between the first part 19*a* of the winding pulley 19 and the locking and unlocking mechanism 51. Furthermore, the second part of the flexible element 9 is formed by the second strand 9*b* extending between the second part 19*b* of the winding pulley 19 and the locking and unlocking mechanism 51.

Moreover, the locking and unlocking mechanism 51 is configured to actuate a lock, not shown. Furthermore, the lock is configured to cooperate with a window catch of the bracket system.

Owing to the present invention, the winding pulley is arranged in the extension of the output shaft of the electromechanical actuator and is rotated around the same rotation axis as the output shaft of the electromechanical actuator.

Furthermore, the first and second strands of the flexible element are respectively guided using the first and second angle transmission mechanisms relative to the first and second parts of the winding pulley.

In this way, the motorized drive device is made compactly, while guaranteeing reliable operation of the window.

Many changes can be made to the example embodiment previously described without going beyond the scope of the invention defined by the claims.

In particular, the motorized drive device 5 can be configured to move several leaves 3*a*, 3*b* by sliding using the flexible element 9, in a same movement direction or in an opposite movement direction.

Furthermore, the angle transmission pulley(s) 35 positioned on the first side and/or the second side of the electromechanical actuator 6 can be replaced by one or several guide elements. Each guide element can, for example, be made by a guide ring comprising a passage opening of the flexible element 9, like those described in the first embodiment shown in FIGS. 3 and 8. Each guide element can, for example, be made using a passage hole arranged in the support 52 or using a hollow and bent tube through which the flexible element 9 can move.

In general, the motorized drive device 5 comprises one or several angle transmission elements 35 positioned on the first side and/or the second side of the electromechanical actuator 6 and configured to guide the flexible element 9 along a predetermined angle, preferably of about 180°, considered alone or in combination.

Moreover, in the case of the first embodiment, the first and second strands 9*a*, 9*b* of the flexible element 9 can also be connected to the locking and unlocking mechanism 51 of the first leaf 3*a* relative to the frame 4, as described previously in reference to the second embodiment.

Furthermore, the considered embodiments and alternatives may be combined to generate new embodiments of the invention, without going beyond the scope of the invention defined by the claims.

The invention claimed is:

1. A sliding window for a building, comprising:

a frame, at least one leaf, a motorized drive device for moving the leaf by sliding relative to the frame, the motorized drive device comprising:

an electromechanical actuator, the electromechanical actuator comprising an electric motor and an output shaft, the rotation axis of the output shaft being parallel to the sliding direction of the leaf relative to the frame, a flexible element, the flexible element being moved by the electromechanical actuator, the flexible element comprising a first strand and a second strand, a carriage that is both attached on the first leaf and connected to the flexible element, a winding pulley of the flexible element, the winding pulley being rotated by the output shaft of the electromechanical actuator, one end of the first strand of the flexible element being connected to a first part of the winding pulley, one end of the second strand of the flexible element being connected to a second part of the winding pulley, wherein the winding pulley and the output shaft of the electromechanical actuator have a same rotation axis, wherein the motorized drive device further comprises:

a first angle transmission mechanism cooperating with the first strand of the flexible element, so as to guide the first strand of the flexible element relative to the first part of the winding pulley, and a second angle transmission mechanism cooperating with the second strand of the flexible element, so as to guide the second strand of the flexible element relative to the second part of the winding pulley.

2. The sliding window for a building according to claim 1, wherein the winding, respectively unwinding, direction of the first strand of the flexible element around the first part of the winding pulley is opposite the winding, respectively unwinding, direction of the second strand of the flexible element around the second part of the winding pulley.

3. The sliding window for a building according to claim 1, wherein each of the first and second angle transmission mechanisms comprises an angle transmission pulley of one of the first and second strands of the flexible element.

4. The sliding window for a building according to claim 3, wherein:

each of the first and second angle transmission mechanisms also comprises a guide element of one of the first and second strands of the flexible element, and the guide element and the angle transmission pulley of each of the first and second angle transmission mechanisms are configured to cooperate with one another, so as to guide one of the first and second strands of the flexible element.

5. The sliding window for a building according to claim 1, wherein:

the frame comprises an upper crosspiece, a lower crosspiece and two lateral uprights, and the electromechanical actuator is attached on the upper crosspiece of the frame using fasteners.

6. The sliding window for a building according to claim 5, wherein the flexible element of the motorized drive device extends along the upper crosspiece of the frame from the first part of the winding pulley to the second part of the winding pulley.

7. The sliding window for a building according to claim 5, wherein the flexible element extends both from one side of the upper face of the upper crosspiece, and also from one side of a lower face of the upper crosspiece, along at least part of the length of the upper crosspiece of the frame.

8. The sliding window for a building according to claim 5, wherein the upper crosspiece of the frame comprises at least one guide element of the flexible element extending along the length of the upper crosspiece.

9. The sliding window for a building according to claim 1, wherein the electromechanical actuator and the winding pulley are assembled on the frame using a first support and a second support, and wherein a mechanism, forming a slider connection along the rotation axis, is arranged between both one of the first and second supports, and the winding pulley or one end of the electromechanical actuator.

10. The sliding window for a building according to claim 1, wherein the first and second strands of the flexible element are connected to a locking and unlocking mechanism of the first leaf relative to the frame.

11. The sliding window for a building according to claim 10, wherein the first strand of the flexible element comprises a first end connected to the first part of the winding pulley and a second end connected to the locking and unlocking mechanism, and wherein the second strand of the flexible element comprises a first end connected to the second part of the winding pulley and a second end connected to the locking and unlocking mechanism.

12. The sliding window for a building according to claim 1, wherein the first and second strands of the flexible element extend in opposite directions, from first and second angle transmission mechanisms.

13. The sliding window for a building according to claim 1, wherein the first and second strands of the flexible element extend in a same direction, from first and second angle transmission mechanisms.

14. The sliding window for a building according to claim 13, wherein a length, measured parallel to a movement direction of the first leaf, of an assembly, formed at least by the electromechanical actuator and the winding pulley is smaller than the width of the first leaf, measured parallel to the same direction.

15. A home automation facility, wherein said facility comprises a sliding window according to claim 1.

* * * * *